US008346111B2

(12) United States Patent
Maehata et al.

(10) Patent No.: US 8,346,111 B2
(45) Date of Patent: Jan. 1, 2013

(54) IMAGE FORMING DEVICE

(75) Inventors: Yasuhiro Maehata, Kanagawa (JP); Yasuhisa Ehara, Kanagawa (JP); Noriaki Funamoto, Tokyo (JP); Tetsuji Nishikawa, Tokyo (JP); Jun Yasuda, Chiba (JP); Hiroaki Murakami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 286 days.

(21) Appl. No.: 12/923,130

(22) Filed: Sep. 3, 2010

(65) Prior Publication Data

US 2011/0058827 A1 Mar. 10, 2011

(30) Foreign Application Priority Data

Sep. 7, 2009 (JP) ..... 2009-205521

(51) Int. Cl.
*G03G 15/16* (2006.01)

(52) U.S. Cl. ..... 399/66; 399/301; 399/302; 347/116

(58) Field of Classification Search ..... 399/66, 399/301, 302; 347/116
See application file for complete search history.

(56) References Cited

U.S. PATENT DOCUMENTS

| | | | | |
|---|---|---|---|---|
| 6,889,022 | B2 | 5/2005 | Ehara et al. | |
| 6,898,400 | B2 | 5/2005 | Ehara | |
| 7,013,102 | B2 | 3/2006 | Ehara | |
| 7,054,586 | B2 * | 5/2006 | Kuroda | 399/302 |
| 7,162,185 | B2 | 1/2007 | Ehara | |
| 7,206,537 | B2 | 4/2007 | Funamoto et al. | |
| 7,215,907 | B2 | 5/2007 | Fukuchi et al. | |
| 7,228,095 | B2 * | 6/2007 | Kuroda | 399/302 |
| 7,352,978 | B2 | 4/2008 | Ebara et al. | |
| 7,366,431 | B2 | 4/2008 | Ehara et al. | |
| 7,369,795 | B2 | 5/2008 | Funamoto et al. | |
| 7,373,097 | B2 | 5/2008 | Ehara | |
| 7,532,842 | B2 | 5/2009 | Handa et al. | |
| 7,536,143 | B2 | 5/2009 | Funamoto | |
| 7,587,157 | B2 | 9/2009 | Matsuda et al. | |

(Continued)

FOREIGN PATENT DOCUMENTS

JP 11-174932 A 7/1999

(Continued)

OTHER PUBLICATIONS

Extended European Search Report for corresponding European Patent Application No. 10174685.7-2209 dated Dec. 16, 2010.

*Primary Examiner* — David Gray
*Assistant Examiner* — G. M. Hyder
(74) *Attorney, Agent, or Firm* — Harness, Dickey & Pierce, P.L.C.

(57) ABSTRACT

A main controlling part is configured to choose and execute either a constant belt speed control which controls a driving motor (a driving source for an intermediate transfer belt) to move the intermediate transfer belt at a predetermined target belt speed or a constant motor speed control which rotates the driving motor at a predetermined target rotational speed according to a print command, and then, prior to a first-time print job, after executing a writing position correcting process while moving the intermediate transfer belt under the constant belt speed control, forms a color shift detecting image by switching from the constant belt speed control to the constant motor speed control, measures a difference between amounts of color shift, and executes a speed correcting process for correcting the target rotational speed of the driving motor in the constant motor speed control based on the measurement result.

7 Claims, 8 Drawing Sheets

U.S. PATENT DOCUMENTS

| | | | | |
|---|---|---|---|---|
| 7,603,061 | B2 | 10/2009 | Ebara et al. | |
| 7,606,505 | B2 | 10/2009 | Kikuchi et al. | |
| 7,630,657 | B2 | 12/2009 | Ehara et al. | |
| 7,653,332 | B2 | 1/2010 | Ehara et al. | |
| 7,693,468 | B2 | 4/2010 | Ehara et al. | |
| 7,697,867 | B2 | 4/2010 | Ehara et al. | |
| 7,702,252 | B2 | 4/2010 | Maehata et al. | |
| 7,706,723 | B2 | 4/2010 | Ishida et al. | |
| 7,729,024 | B2 | 6/2010 | Kobayashi et al. | |
| 2003/0152402 | A1 | 8/2003 | Ehara et al. | |
| 2004/0009011 | A1 | 1/2004 | Ehara | |
| 2004/0126137 | A1 | 7/2004 | Ehara | |
| 2004/0197111 | A1 | 10/2004 | Kuroda | |
| 2005/0058470 | A1 | 3/2005 | Funamoto et al. | |
| 2005/0084293 | A1 | 4/2005 | Fukuchi et al. | |
| 2005/0088505 | A1* | 4/2005 | Shinohara | 347/116 |
| 2005/0137745 | A1* | 6/2005 | Takayama et al. | 700/230 |
| 2006/0039722 | A1 | 2/2006 | Ehara | |
| 2006/0056865 | A1 | 3/2006 | Ehara et al. | |
| 2006/0056868 | A1 | 3/2006 | Ebara et al. | |
| 2006/0165422 | A1 | 7/2006 | Kikuchi et al. | |
| 2006/0182465 | A1 | 8/2006 | Funamoto et al. | |
| 2006/0210325 | A1 | 9/2006 | Funamoto | |
| 2006/0280523 | A1* | 12/2006 | Sakai | 399/167 |
| 2007/0097465 | A1 | 5/2007 | Kobayashi et al. | |
| 2007/0110477 | A1 | 5/2007 | Handa et al. | |
| 2007/0122172 | A1 | 5/2007 | Ebara et al. | |
| 2007/0140736 | A1 | 6/2007 | Ehara et al. | |
| 2007/0166075 | A1 | 7/2007 | Funamoto et al. | |
| 2007/0172257 | A1 | 7/2007 | Matsuda et al. | |
| 2007/0196132 | A1 | 8/2007 | Kobayashi et al. | |
| 2007/0212109 | A1 | 9/2007 | Ebara et al. | |
| 2007/0253736 | A1 | 11/2007 | Ehara et al. | |
| 2007/0258729 | A1 | 11/2007 | Ehara et al. | |
| 2007/0274746 | A1 | 11/2007 | Ehara et al. | |
| 2008/0069604 | A1 | 3/2008 | Ebara et al. | |
| 2008/0069635 | A1 | 3/2008 | Maehata et al. | |
| 2008/0089713 | A1 | 4/2008 | Ishida et al. | |
| 2008/0124152 | A1 | 5/2008 | Nishikawa et al. | |
| 2008/0131168 | A1 | 6/2008 | Ehara et al. | |
| 2008/0166153 | A1 | 7/2008 | Ehara et al. | |
| 2008/0213000 | A1 | 9/2008 | Funamoto et al. | |
| 2008/0240754 | A1 | 10/2008 | Kobayashi et al. | |
| 2008/0260420 | A1 | 10/2008 | Maehata et al. | |
| 2008/0282839 | A1 | 11/2008 | Suzuki et al. | |
| 2009/0074506 | A1 | 3/2009 | Sugiyama et al. | |
| 2009/0234498 | A1* | 9/2009 | Takahashi et al. | 700/230 |
| 2009/0238588 | A1 | 9/2009 | Matsuda et al. | |
| 2009/0317109 | A1 | 12/2009 | Ehara et al. | |
| 2010/0183322 | A1 | 7/2010 | Funamoto et al. | |
| 2010/0226676 | A1 | 9/2010 | Funamoto et al. | |

FOREIGN PATENT DOCUMENTS

| | | | |
|---|---|---|---|
| JP | 20000172125 | A | 6/2000 |
| JP | 2004-205717 | A | 7/2004 |
| JP | 2006323422 | A | 11/2006 |

* cited by examiner

IMAGE FORMING DEVICE

BACKGROUND OF THE INVENTION

1. Field of the Invention

The present invention relates to an image forming device for obtaining a multicolor image by superimposing and transferring toner images, which have different colors from each other and formed on respective surfaces of a plurality of latent image carriers, onto a surface of an endless belt member or onto a recording member retained on the surface.

2. Description of the Related Art

The image forming device of this kind sometimes causes a color shift due to the transfer of each color toner image with positional displacements in a belt moving direction. One of the causes of the color shift is a relative shift between the latent image writing positions on each color latent image carrier. Specifically, if a latent-image-writing-related member such as a reflective mirror or a scan lens expands or contracts in response to temperature changes, the latent image writing positions are sometimes shifted relatively between each color latent image carrier. In case that such a shift of the latent image writing position occurs, a relative positional displacement of the latent image arises between each color latent image carrier, thereby color shift occurs.

Another cause of the positional displacement of each color toner image is a speed variance of the belt member due to an eccentricity of a driving roller for transferring a driving force to the belt member. Specifically, if the driving roller is eccentric, the belt member causes a speed variance with properties which draw a sine curve having one cycle per one revolution of the roller. Due to this speed variance, each color toner image is transferred with positional displacement from each color latent image carrier to the belt member or to the recording member on the surface of the belt member, thereby a color shift occurs.

Thus, the image forming device described in unexamined Japanese Patent Publication No. 2004-205717 reduces a relative shift of latent image writing positions between each color photoreceptor by periodically executing a writing position correcting process for correcting the latent image writing position relative to each color photoreceptor (i.e. each latent image carrier). Firstly, in the writing position correcting process, the image forming device transfers predetermined toner images formed on each color photoreceptor onto the surface of the belt member, and forms an image for detecting color shift on the surface of the belt member. Then, the image forming device calculates amounts of positional displacements of each toner image in a belt moving direction based on timing for detecting each color toner image formed on the color shift detecting image by reflective photo sensors. Next, based on the calculation results, the image forming device fine-adjusts an inclination angle of the reflective mirror in an optical scanning system for writing a latent image, or fine-adjusts timing for irradiating the photoreceptor. In this way, the image forming device can reduce color shift by reducing a relative shift of the latent image writing position between each color photoreceptor.

In addition, the image forming device stabilizes a speed of the belt member by executing a constant belt speed control for driving a driving motor so that the image forming device rotates the endless belt member at a constant speed based on detected result of a moving speed of the belt member. Specifically, the image forming device is provided with a rotary encoder attached to a driven roller which is one of a plurality of tensioning rollers for tensioning the belt member and which is rotated by the movement of the belt member. The image forming device detects a moving speed of the belt member based on the detection result of the rotary encoder. In the case where there is a speed variance of the belt member, the image forming device feedbacks the detection result of the rotary encoder to the driving motor to generate an opposite phase speed variance relative to the speed variance. In this way, the image forming device can reduce color shift due to the speed variance of the belt member by reducing the speed variance of the belt member due to the eccentricity of the driving roller and by stabilizing the speed of the belt member.

In this respect, the inventors have conducted an experiment for increasing the print speed by using a testing machine of the above mentioned image forming device and have found out that the testing machine is subject to a streaky image disturbance when using a cardboard as a recording paper. Specifically, the testing machine is configured to superimpose and primary-transfer color toner images onto the surface of the belt member, and to secondary-transfer the primary-transferred color toner images collectively from the belt member to a recording paper at a secondary transfer nip by bringing the belt member into contact with a secondary transferring roller. In such a configuration, if a cardboard is used as a recording paper, the testing machine instantaneously reduces the moving speed of the belt member significantly due to rapid increase in load, when feeding the cardboard into the secondary transfer nip. Under the condition of the print speed higher than before, the reduction rate also becomes larger. Consequently, if the testing machine feedbacks the speed reduction to the drive control of the driving motor, the testing machine instantaneously increases the speed of the belt member excessively. If such an instantaneous speed reduction at the time of feeding the cardboard into the nip and such a subsequent instantaneous speed increase occur, the testing machine causes the above mentioned streaky image disturbance without transferring toner images from the photoreceptors to the belt member properly. This streaky image disturbance is far more outstanding than the color shift caused by the eccentricity of the driving roller. Therefore, countermeasures should be taken in priority to the color shift.

The above mentioned testing machine is configured to superimpose and transfer each toner image of each color photoreceptor onto the belt member, and then secondary-transfer the toner images collectively to the recording paper at the secondary transfer nip. However, the following configuration can also cause a similar streaky image disturbance. The configuration superimposes and transfers each toner image of each color photoreceptor onto a recording paper retained on the surface of the belt member. This is because such a configuration causes instantaneous speed reduction and instantaneous speed increase of the belt member each time the testing machine feeds a cardboard into each color primary transfer nip by bringing each color photoreceptor into contact with the belt member.

To that end, the inventors are developing a novel image forming device for executing a constant motor speed control by using a FG signal when using a cardboard, instead of the above mentioned constant belt speed control. The FG signal is a signal sent from a FG signal generator (Frequency Generator) which generates a pulse wave each time it detects a predetermined rotational angle displacement of a motor shaft. In the constant motor speed control, the image forming device rotates a driving motor at a predetermined target rotational speed constantly by driving the driving motor to keep the frequency of the FG signal constant. As described above, when the cardboard enters into the nip, a speed of the belt member instantaneously decreases significantly. However, since the belt stretches at the same time, the rotational speed of the driving motor does not decrease that much. Thus, without detecting a rapid decrease of the rotational speed of the motor when a cardboard enters into a nip, the image forming device keeps the driving motor rotating stably at the target rotational speed from the entrance of the cardboard into the nip until the ejection of the cardboard from the nip. Consequently, the image forming device no longer instantaneously increases the speed of the belt member excessively just after the cardboard enters the nip. In such a configuration, although the image forming device does not prevent color shift caused by the eccentricity of the driving roller from occurring, the image forming device can reduce the above mentioned streaky image disturbance.

The inventors have produced a testing machine which switches the constant belt speed control to the constant motor speed control when using a cardboard, and have tested it. Then, the test resulted significant color shift. The inventors have found out that this significant color shift is caused by the following reason. As described above, the constant motor speed control rotates the driving motor at a predetermined target rotational speed. If a diameter of the driving roller is a value as planed, an average linear speed of the driving roller at the time becomes almost the same value as the predetermined target speed of the belt member. However, the driving roller is generally coated by material with large frictional resistance such as a rubber in order to exert a large grip force on the belt member. In such a driving roller, due to the limitation of the machining accuracy, an error in the diameter is unavoidable. In the driving roller including a slight error in the diameter, if the driving motor is rotated at the predetermined target rotational speed, the average linear speed of the surface of the driving roller slightly deviates from the target speed of the belt member. Due to this deviation, it is found out that the constant motor speed control has been moving the belt member at an average speed different from that in the constant belt speed control. Although the testing machine executes the above described writing position correcting process under the condition of the constant belt speed control, the testing machine can reduce color shift by the execution only when the testing machine drives the driving motor by using the constant belt speed control. This is due to the following reason. That is, once the testing machine switches the control method from the constant belt speed control to the constant motor speed control, the testing machine differentiates a subsequent average speed of the belt member from the average speed of the belt member during the writing position correcting process. Thus, the testing machine differentiates time, which is required for the belt member to move from an upstream primary transfer nip to a downstream primary transfer nip, from corresponding time during the writing position correcting process. Consequently, the testing machine can no longer superimpose toner images at each primary transfer nip without any displacement.

Although the testing machine is configured to execute the writing position correcting process under the constant belt speed control, if the testing machine executes the writing position correcting process under the constant motor speed control, the testing machine causes similar color shift when switching the control method of the driving motor from the constant motor speed control to the constant belt speed control.

In view of the above mentioned problems, it is an object of the present invention to provide a following image forming device. That is, the object is to provide an image forming device which can reduce the generation of a streaky image disturbance and which can reduce the generation of color shift caused by the fact that an average speed of the belt member is different from the average speed during the writing position correcting process due to the switching of the control method between the constant belt speed control and the constant motor speed control.

SUMMARY OF THE INVENTION

To achieve the object above, an embodiment of the present invention is an image forming device comprising an imaging part configured to develop latent images, which are written on each of a plurality of latent image carriers, with toners having colors different from each other, and to form toner images having colors different from each other on each of the latent image carriers, a belt unit having an endless belt member and a rotating body configured to move the belt member along with its rotation, a transferring part configured to form a multicolor image by superimposing and transferring the toner images formed on the plurality of the latent image carriers onto a surface of the belt member or onto a recording member retained on the surface, a driving motor serving as a drive source of the rotating body, a belt speed detecting part configured to detect a moving speed of the belt member, and a controlling part configured to control the imaging part, the transferring part, and the driving motor, wherein the controlling part executes a constant belt speed control configured to drive the driving motor based on a detection result of the belt speed detecting part so that the belt member moves at a predetermined target belt speed, and a writing position correcting process configured to form a color shift detecting image composed of each color toner image on the surface of the belt member by using the imaging part and the transferring part, to detect an amount of positional displacement of each color toner image formed on the color shift detecting image by using a positional displacement detecting part, and to reduce positional displacements of each color toner image by correcting each latent image writing position of the plurality of latent image carrier individually based on a detection result of the positional displacement detecting part, if the controlling part executes a print job based on a user command, according to the user command, the controlling part chooses and executes either the constant belt speed control or a constant motor speed control configured to drive the driving motor based on a detection result of a rotational speed detecting part configured to detect a rotational speed of the driving motor so that the driving motor constantly rotates at a predetermined target rotational speed, prior to executing a first-time print job by the user, after executing the writing position correcting process while moving the belt member under the control of one of the constant belt speed control and the constant motor speed control, the controlling part forms a color shift detecting image including a toner image having at least two colors while moving the belt member under the control of the other of the constant belt speed control and the constant motor speed control, and the controlling part executes a speed correcting process configured to correct either the target rotational speed of the driving motor in the constant motor speed control or the target belt speed in the constant belt speed control based on a detection result of the positional displacement detecting part.

In the above mentioned embodiment, the controlling part determines based on the user command whether an imaging condition during the print job is a condition which is likely to give rise to a streaky image disturbance such as a condition where a relatively thick recording member is used or a condition where a relatively high print speed is used. Then, if the controlling part determines that the imaging condition during the print job is a condition which is likely to give rise to the streaky image disturbance, the controlling part chooses the constant motor speed control as a control method of the belt member. In this way, the controlling part can reduce the development of the streaky image disturbance.

Prior to executing the first-time print job by the user, the controlling part corrects the target rotational speed of the driving motor under the constant belt speed control to a value corresponding to a diameter of the rotating body. Specifically, the controlling part reduces the positional displacement of the latent image writing position by executing the writing position correcting process under either the constant belt speed control or the constant motor speed control. Then, the controlling part forms the color shift detecting image after switching the control method of the belt member from one of the constant belt speed control and the constant motor speed control to the other, and detects the amount of the positional displacement of the toner image. Since the controlling part differentiates the average speed of the belt member from that in the before-switching control method despite executing the writing position correcting process, the controlling part detects a relatively large amount of positional displacement. The difference between this amount of the positional displacement and the amount of the positional displacement in the before-switching control method indicates the difference between the average speed of the belt member in the constant belt speed control and that in the constant motor speed control. Based on this difference between the average speeds, the controlling part corrects the target rotational speed used in the constant motor speed control or the target belt speed used in the constant belt speed control so that the controlling part can move the belt member at the same speed as the average speed in the before-switching control method. In this way, by moving the belt member at the same average speed as the average speed when executing the writing position correcting process, the controlling part can reduce color shift caused by differentiating the average speed of the belt member from the average speed when executing the writing position correcting process under the after-switching control method.

DETAILED DESCRIPTION OF THE PREFERRED EMBODIMENTS

Hereinafter, as an image forming device in accordance with the present invention, an embodiment of an electrophotographic printer (hereinafter simply called "printer") is described.

Figure 1:
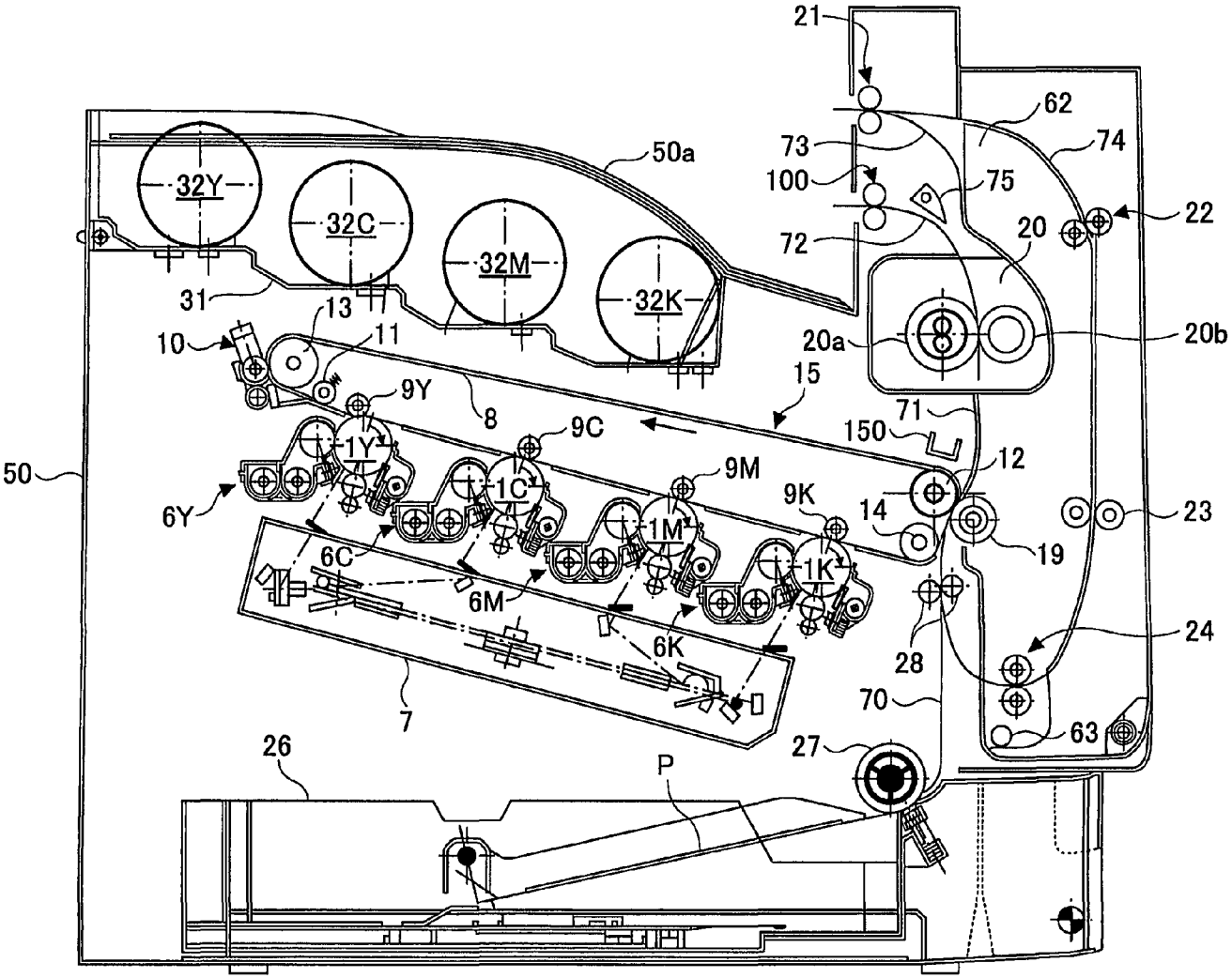
FIG. 1 is a schematic configuration diagram of a printer in accordance with an embodiment.
Figure 2:
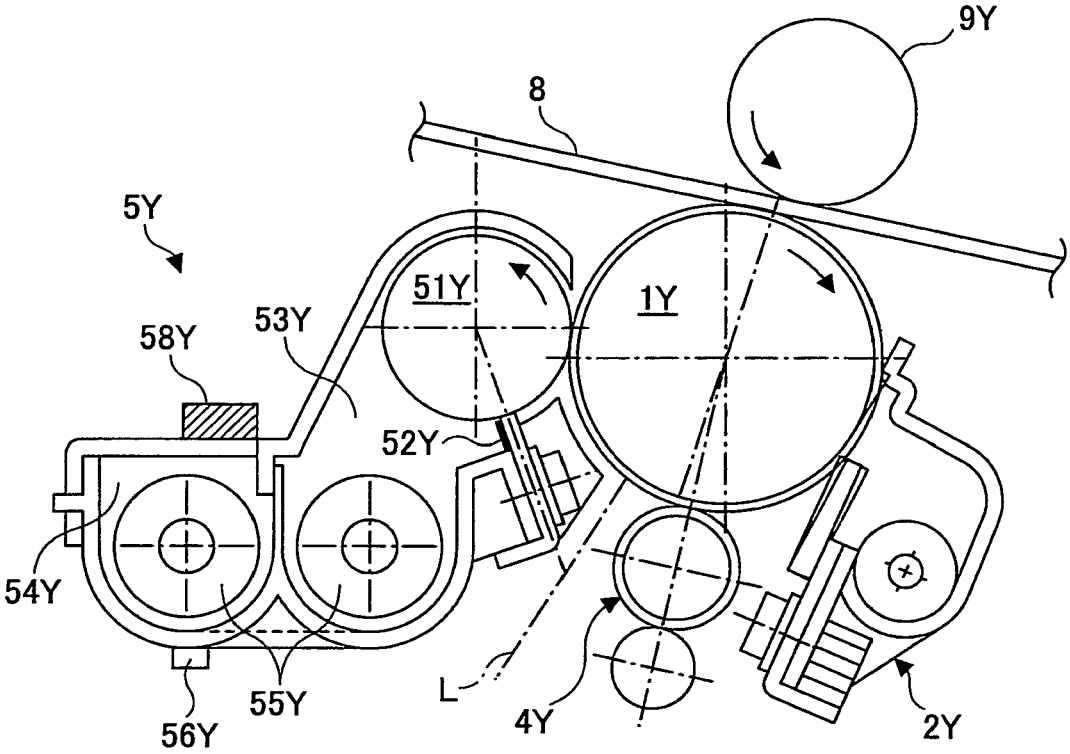
FIG. 2 is a magnified configuration diagram magnifying a process unit for Yellow in the printer.

Firstly, a basic configuration of the printer in accordance with the present embodiment is described. FIG. 1 is a schematic configuration diagram of the printer in accordance with the embodiment. In FIG. 1, the printer is provided with four process units 6Y, 6C, 6M, and 6K for forming toner images in yellow, cyan, magenta, and black, respectively (Hereinafter referred to as Y, C, M, and K). They use a Y toner, a C toner, a M toner, and a K toner, which are different colors from each other, as image forming materials. They have the same configuration other than the image forming material, and can be replaced at the end of their lifetime. Taking as an analogy the process unit 6Y for forming a Y toner image, as shown in FIG. 2, the process unit 6Y is provided with a drum type photoreceptor 1Y as an image carrier, a drum cleaning device 2Y, a neutralizing device (not shown), a charging device 4Y, a developing machine 5Y and the like. The process unit 6Y is configured to be detachable to a printer body and is able to replace consumable parts at a time.

The charging device 4Y is configured to charge uniformly the surface of the photoreceptor 1Y which is rotated clockwise in the figure by a driving device (not shown). The uniformly charged surface of the photoreceptor 1Y is exposed to laser light, scanned, and carries an electrostatic latent image for Y. The electrostatic latent image for Y is developed to a Y toner image by the developing machine 5Y which uses a Y developer containing a Y toner and a magnetic carrier. Then, the Y toner image is transferred onto an intermediate transfer belt 8 which is an after mentioned belt member. The drum cleaning device 2Y removes residual toners on the surface of the photoreceptor 1Y after an intermediate transfer process. The above mentioned neutralizing device neutralizes residual charges on the photoreceptor 1Y after cleaning. Due to this neutralization, the process unit 6Y can initialize the surface of the photoreceptor 1Y and get ready for a next image forming. In a similar manner, process units 6C, 6M, and 6K for other colors can form C, M, and K toner images on the photoreceptors 1C, 1M, and 1K and transfer them onto the intermediate transfer belt 8.

The developing machine 5Y includes a developing roll 51Y arranged to expose a part thereof from an opening of its casing. The developing machine 5Y also includes two carrier screws 55Y set parallel to each other, a doctor blade 52Y, a toner concentration sensor (hereinafter called "T sensor") 56Y and the like.

The Y developer (not shown) including the magnetic carrier and the Y toner is contained in the casing of the developing machine 5Y. This Y developer is stirred and carried by the two carrier screws 55Y and frictionally charged. After that, the Y developer is supported on the surface of the above mentioned developing roll 51Y. Then, the Y developer is carried to a developing area facing the photoreceptor 1Y with its layer thickness regulated by the doctor blade 52Y. At this stage, the Y developer transfers the Y toner onto an electrostatic latent image on the photoreceptor 1Y. Due to this transfer, a Y toner image is formed on the photoreceptor 1Y. In the developing machine 5Y, the Y developer whose Y toner is consumed by the development is returned to the casing by the rotation of the developing roll 51Y.

There is a partition wall between the two carrier screws 55Y. This partition wall partitions the casing into a first supply part 53Y, which houses the developing roll 51Y and the carrier screw 55Y on the right side of the figure, and a second supply part 54Y, which houses the carrier screw 55Y on the left side of the figure. The carrier screw 55Y on the right side of the figure, which is rotated by a driving device (not shown), supplies the developing roll 51Y with the Y developer within the first supply part 53Y while carrying the Y developer from the front side of the figure to the back side of the figure. The Y developer, which is carried to near the end of the first supply part 53Y by the carrier screw 55Y on the right side of the figure, enters into the second supply part 54Y through an opening (not shown) arranged in the above mentioned partition wall. In the second supply part 54Y, the carrier screw 55Y on the left side of the figure, which is rotated by a driving device (not shown), carries the Y developer, which comes from the first supply part 53Y, to a direction opposite to the carrier screw 55Y on the right side of the figure. The Y developer, which is carried to near the end of the second supply part 54Y by the carrier screw 55Y on the left side of the figure, returns into the first supply part 53Y through another opening (not shown) arranged in the above mentioned partition wall.

The above mentioned T sensor 56Y or a magnetic permeability sensor, which is arranged on the bottom wall of the second supply part 54Y, outputs voltage value corresponding to magnetic permeability of the Y developer passing above it. Since magnetic permeability of a two-component developer including a toner and a magnetic carrier shows good correlation with toner concentration, the T sensor 56Y outputs voltage value corresponding to a Y toner concentration. This output voltage value is sent to a controlling part (not shown). This controlling part is provided with a RAM storing a Vtref for Y which is a target value of the output voltage of the T sensor 56Y. This RAM also stores a Vtref for C, a Vtref for M, and a Vtref for K which are target values of output voltages of T sensors (not shown) mounted on other developing machines. The Vtref for Y is used for a drive control of an after mentioned toner carrying device for Y. Specifically, the controlling part replenishes the Y toner into the second supply part 54Y by driving the toner carrying device for Y (not shown) so that an output voltage value of the T sensor 56Y approaches the Vtref for Y. Due to this replenishment, the Y toner concentration in the Y developer in the developing machine 5Y is maintained within a predetermined range. The similar toner replenishment control by using toner carrying devices for C, M, and K is performed in other developing machine of other process units.

In FIG. 1 shown before, an optical writing unit 7 as a latent image writing device is arranged below the process units 6Y, 6C, 6M, and 6K. The optical writing unit 7 irradiates photoreceptors in each of the process units 6Y, 6C, 6M, and 6K with laser light emitted based on image information and exposes the photoreceptors to the laser light. Due to this exposure, electrostatic latent images for Y, C, M, and K are formed on the photoreceptors 1Y, 1C, 1M, and 1K. The optical writing unit 7 irradiates the photoreceptors with the laser light emitted from a light source through a plurality of optical lenses or mirrors, while scanning the laser light by a polygon mirror rotationally driven by a motor.

Below the optical writing unit 7, a paper containing device, which has a paper containing cassette 26, a paper feeding roller 27 mounted therein, and the like, is arranged. The paper containing cassette 26, which contains a stack of transfer papers P or sheeted recording media, bring the topmost transfer paper P into contact with the paper feeding roller 27. When the paper feeding roller 27 is rotated counter clockwise by a driving device (not shown), the paper feeding roller 27 feeds the topmost transfer paper P toward a paper feeding path 70.

Near the end of this paper feeding path 70, a pair of registration rollers 28 is arranged. The pair of registration rollers 28 rotates both rollers for sandwiching the transfer paper P therebetween and then stops the rotation immediately after the sandwiching. Then, the pair of registration rollers 28 sends out the transfer paper P toward an after mentioned secondary transfer nip at the right time.

Above the process units 6Y, 6C, 6M, and 6K, a transfer unit 15, which moves the tensioned endless intermediate transfer belt 8, is arranged. The transfer unit 15 as a transferring device is provided with a secondary transfer bias roller 19, a belt cleaning device 10 and so on, other than the intermediate transfer belt 8. The transfer unit 15 is also provided with four primary transfer bias rollers 9Y, 9C, 9M, and 9K, a driving roller 12, a cleaning backup roller 13, a driven roller 14, a tension roller 11 and so on. The intermediate transfer belt 8 is tensioned by these rollers and is rotated counter clockwise by the rotation of the driving roller 12. The primary transfer bias rollers 9Y, 9C, 9M, and 9K respectively form primary transfer nips by sandwiching the thus rotated intermediate transfer belt 8 between the primary transfer bias rollers 9Y, 9C, 9M, and 9K on the one hand and the photoreceptors 1Y, 1C, 1M, and 1K on the other hand. These are the type which applies a transfer bias, which has polarity (positive for example) opposite to that of the toner, onto the back surface (an inner loop surface) of the intermediate transfer belt 8. Rollers other than the primary transfer bias rollers 9Y, 9C, 9M, and 9K are all grounded electrically. The Y, C, M, and K toner images on the photoreceptors 1Y, 1C, 1M, and 1K are superimposed and primary-transferred onto the intermediate transfer belt 8 at the time when the rotating intermediate transfer belt 8 passes through the primary transfer nips for Y, C, M, and K sequentially. In this way, a four-color superimposed toner image (hereinafter called "four-color toner image") is formed on the intermediate transfer belt 8.

The driving roller 12, as a driving rotating body, forms in cooperation with the secondary transfer roller 19 a secondary transfer nip for sandwiching the intermediate transfer belt 8 therebetween. The four-color toner image, which is formed on the intermediate transfer belt 8 as a visible image, is transferred to the transfer paper P at this secondary transfer nip. Then, the four-color toner image becomes a full color toner image in combination with white color on the transfer paper P. Residual toners which have not been transferred to the transfer paper P stay attached to the intermediate transfer belt 8 which has passed through the secondary transfer nip. These residual toners are cleaned up by the belt cleaning device 10. The transfer paper P, to which the four-color toner image is secondary-transferred at the secondary transfer nip collectively, is sent to a settling device 20 via an after-transfer carrying path 71.

The settling device 20 forms a settling nip by a settling roller 20*a*, which has a heat source such as a halogen lamp therein, and a pressure roller 20*b*, which rotates while contacting the settling roller 20*a* at a predetermined pressure. The transfer paper P, which is fed into the settling device 20, is sandwiched by the settling nip so that its unsettled toner image supporting surface comes in contact with the settling roller 20*a*. Then, the toners in the toner image are softened under the influence of heating and pressurization, and a full color image is settled.

The transfer paper P, on which the full color image is settled in the settling device 20, enters a bifurcation point between an ejecting path 72 and a before-reverse carrying path 73 after the settling device 20. In this bifurcation point, a first switching click 75 is arranged pivotally, the first switching click 75 switches the path of the transfer paper P by pivoting. Specifically, by moving the leading edge of the first switching click 75 closer to the before-reverse carrying path 73, the first switching click 75 switches the path of the transfer paper P to a direction toward the ejecting path 72. Also, by moving the leading edge of the first switching click 75 away from the before-reverse carrying path 73, the first switching click 75 switches the path of the transfer paper P to a direction toward the before-reverse carrying path 73.

If a path toward the ejecting path 72 is selected by the first switching click 75, the transfer paper P is ejected through the ejecting path 72 and a pair of ejecting rollers 100 to the outside of the image forming device and stacked on a stack 50*a* arranged on a upper surface of a printer housing. In contrast, if a path toward the before-reverse carrying path 73 is selected by the first switching click 75, the transfer paper P enters into a nip between a pair of reverse rollers 21 via the before-reverse carrying path 73. The pair of reverse rollers 21 carries the transfer paper P sandwiched between rollers toward the stack 50*a*, and reverses the rollers just before the trailing edge of the transfer paper P enters into the nip. Due to this reversal, the transfer paper P is carried in a direction opposite to the previous direction. Thus, the trailing edge side of the transfer paper P enters into a reverse carrying path 74.

The reverse carrying path 74 has a curved shape extending from vertical upper side to vertical lower side. The reverse carrying path 74 also includes in its path a first reverse carrying roller pair 22, a second reverse carrying roller pair 23, and a third reverse carrying roller pair 24. The transfer paper P flips upside down by being carried sequentially through nips formed by these roller pairs. The flipped transfer paper P returns to the above mentioned the paper feeding path 70 and then reaches the secondary transfer nip again. This time, the transfer paper P enters into the secondary transfer nip while bringing its image non-supporting surface into contact with the intermediate transfer belt 8. In this way, a second four-color toner image on the intermediate transfer belt 8 is secondary-transferred to the image non-supporting surface collectively. Then, the transfer paper P is carried through the after-transfer carrying path 71, the settling device 20, the ejecting path 72, and the pair of ejecting rollers 100, and stacked on the stack 50*a* outside of the image forming device. By such a reverse carrying, full color images are formed on both sides of the transfer paper P.

Between the transfer unit 15 and the stack 50*a* arranged above the transfer unit 15, a bottle supporting part 31 is arranged. This bottle supporting part 31 mounts toner bottles 32Y, 32C, 32M, and 32K as toner containing parts for containing the Y toner, the C toner, the M toner, and the K toner, respectively. The toner bottles 32Y, 32C, 32M, and 32K are arranged so that each of them is apposed while forming a slight angle in relation to the horizontal. The position of the toner bottle 32Y is the highest, followed by the toner bottle 32C, the toner bottle 32M, and the toner bottle 32K. The Y, C, M, and K toners in the toner bottles 32Y, 32C, 23M, and 32K are replenished accordingly into the developing machines in the process units 6Y, 6C, 6M, and 6K by after mentioned toner carrying devices, respectively. These toner bottles 32Y, 32C, 32M, and 32K are detachable from the printer body independently of the process units 6Y, 6C, 6M, and 6K.

This printer differentiates the contact state between the photoreceptors and the intermediate transfer belt 8 in the monochromatic mode where a monochromatic image is formed, from the contact state in the chromatic mode where a color image is formed. Specifically, the primary transfer bias roller 9K, which is one out of four primary transfer bias rollers 9Y, 9C, 9M, and 9K in the transfer unit 15, is supported by a dedicated bracket (not shown) apart from other primary transfer bias rollers. Three primary transfer bias rollers 9Y, 9C, and 9M are supported by a common moving bracket (not shown). This common moving bracket can be moved in a direction closer to the photoreceptors 1Y, 1C, and 1M on the one hand, and in a direction away from the photoreceptors 1Y, 10, and 1M on the other hand, by driving a solenoid (not shown). If the moving bracket is moved away from the photoreceptors 1Y, 10, and 1M, the intermediate transfer belt 8 changes its tensioned position and moves away from the three photoreceptors 1Y, 10, and 1M. The photoreceptor 1K remains in contact with the intermediate transfer belt 8. Thus, in the monochromatic mode, the image forming device performs an image forming operation while bringing the photoreceptor 1K into contact with the intermediate transfer belt 8. In this case, the image forming device rotates the photoreceptor 1K, which is one out of four photoreceptors, and stops driving the photoreceptors 1Y, 10, and 1M.

If the moving bracket is moved closer to the three photoreceptors 1Y, 10, and 1M, the intermediate transfer belt 8, which has been away from the three photoreceptors 1Y, 10, and 1M, changes its tensioned position and comes into contact with the three photoreceptors 1Y, 1C, and 1M. In this case, the photoreceptor 1K remains in contact with the intermediate transfer belt 8. Thus, in the chromatic mode, the image forming device performs an image forming operation while bringing all the four photoreceptors 1Y, 1C, 1M, and 1K into contact with the intermediate transfer belt 8. In such a configuration, the moving bracket, the above mentioned solenoid and the like are functioning as a connection/disconnection device for connecting/disconnecting the photoreceptors and the intermediate transfer belt 8.

The printer is provided with a main controlling part (not shown) as a control device for controlling the operation of an imaging device including the four process units 6Y, 6C, 6M, and 6K, the optical writing unit 7 and the like. This main controlling part is provided with a CPU (Central Processing Unit) as an arithmetic device, a RAM (Random Access Memory) as a data storing device, a ROM (Read Only Memory) as a data storing device, and the like. The main controlling part controls the operation of the process units and the optical writing unit 7 based on programs stored in the ROM.

The printer also has a drive controlling part (not shown) apart from the main controlling part. This drive controlling part is provided with a CPU, a ROM, a non-volatile RAM as a data storage device, and the like. The drive controlling part controls the operation of an after mentioned driving motor based on programs stored in the ROM.

The printer according to the embodiment causes color shift in a chromatic image if each transfer position for each color toner image on the intermediate transfer belt 8 is out of alignment. Such color shift is caused by a sub-scanning registration shift for each color toner image and the like. The sub-scanning registration shift is a phenomenon in which a normal transfer position of the toner image generally shifts in the sub-scanning direction which is the moving direction of the intermediate transfer belt 8. The main cause of the sub-scanning registration shift is expansion and contraction of a component of the optical writing unit 7 such as a reflective mirror, a lens, and the like caused by temperature changes. During a continuous printing operation for forming images on a plurality of recording papers continuously, since the optical writing unit 7 continues to heat up, the amount of color shift increases with the length the duration of the continuous operation.

Figure 3:
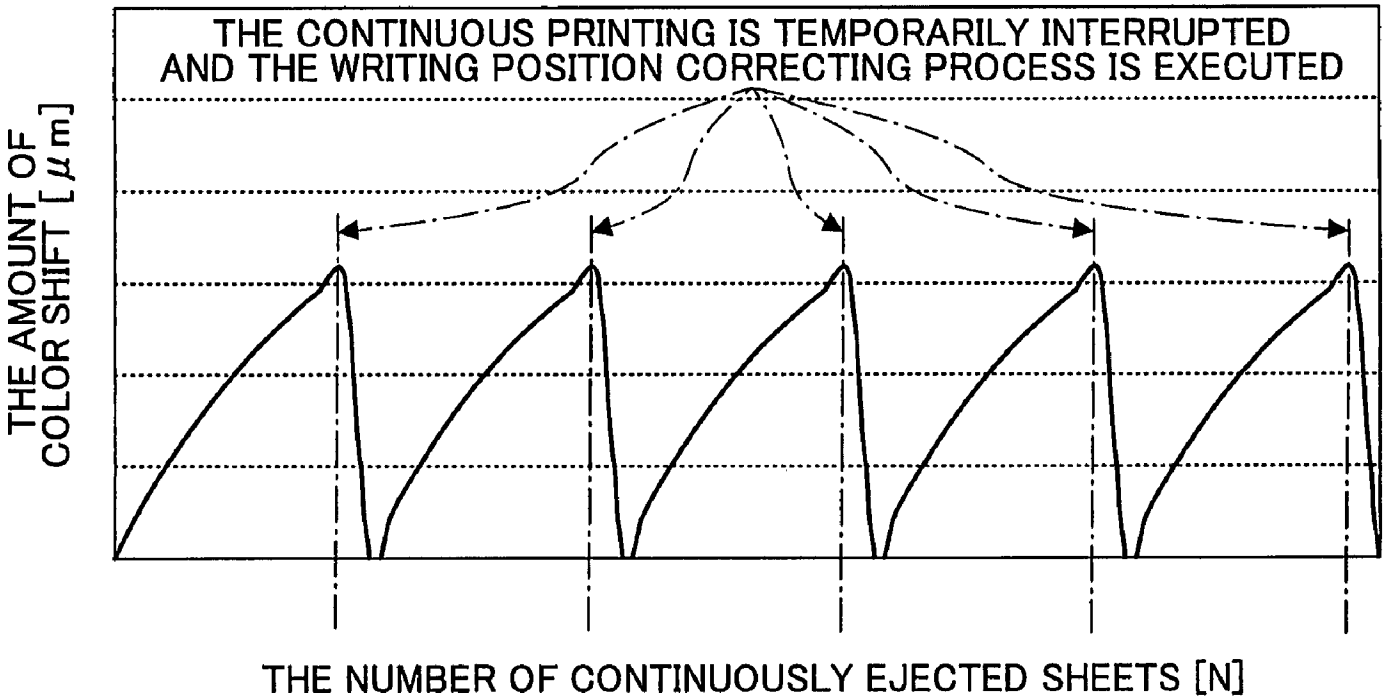
FIG. 3 is a graph illustrating a relationship between the number of continuously ejected sheets and an amount of color shift.

To that end, the main controlling part of this printer executes the following writhing position correcting process. That is, after the main controlling part transferred each toner image formed on each color photoreceptor onto the belt side by side, the main controlling part detects the amount of positional displacement of each color toner image based on the time when an optical sensor, which serves as a positional displacement detecting device, detects the toner images. Then, the main controlling part reduces an amount of a sub-scanning registration shift by correcting the time of initiation of a latent image writing based on the detection result. In this way, as shown in FIG. 3, in the continuous printing mode, the main controlling part can reset the amount of color shift, which increases gradually with increase in the number of the sheets printed continuously, close to zero periodically by executing the writing position correcting process periodically.

Figure 4:
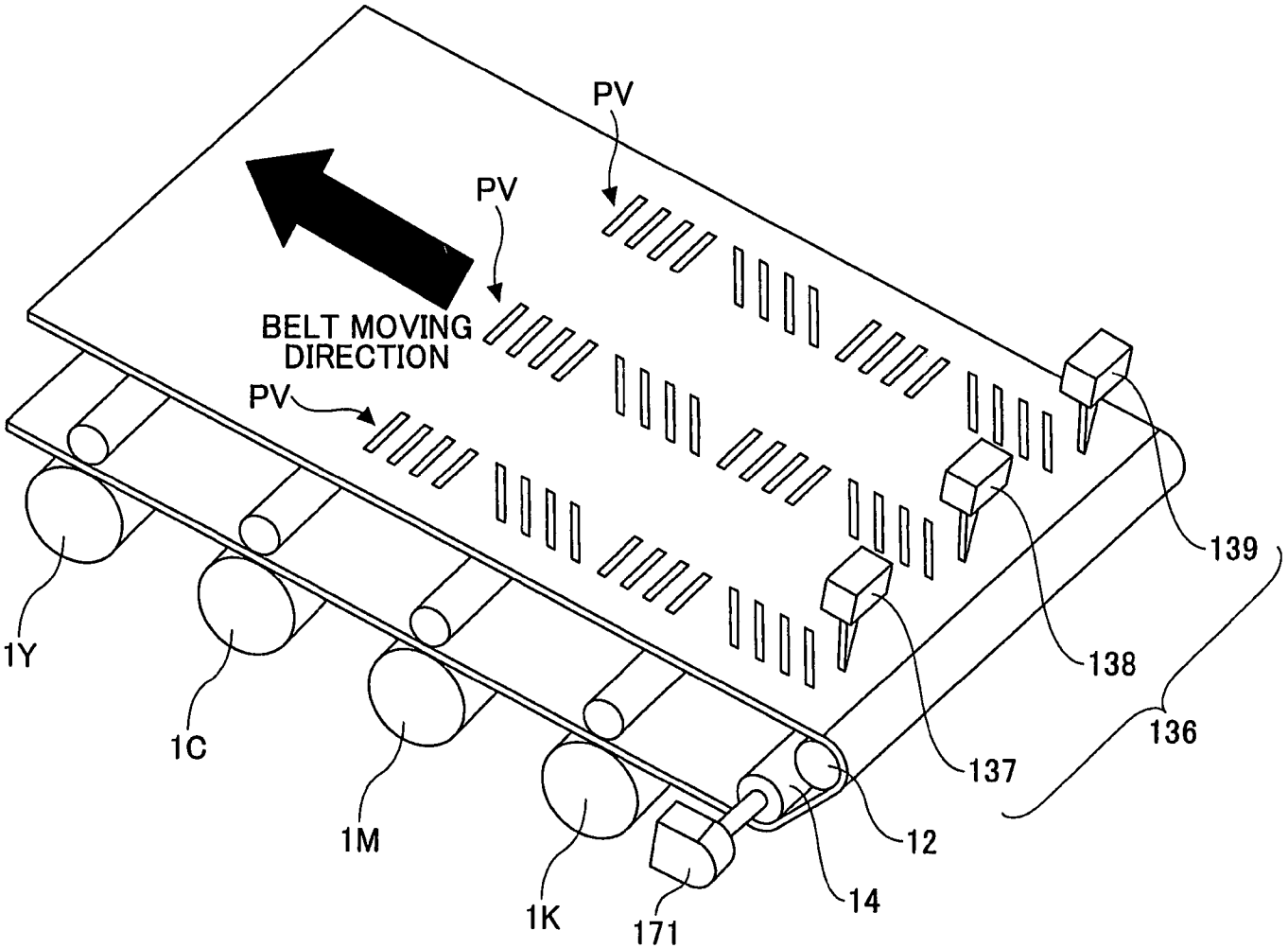
FIG. 4 is a magnified perspective view illustrating a part of an intermediate transfer belt of the printer and an optical sensor unit.

FIG. 4 is a magnified perspective view illustrating a part of the intermediate transfer belt 8 together with an optical sensor unit 136 which serves as the positional displacement detecting device. As shown in the figure, the optical sensor units 136 face the intermediate transfer belt 8 across a predetermined distance at the place where the intermediate transfer belt 8 is in contact with the driving roller 12. The main controlling part is supposed to execute the writing position correcting process just after a power switch (not shown) is turned ON, or each time a predetermined number of sheets are printed. Then, in the writing position correction process, the main controlling part forms color shift detecting images, which are composed of a plurality of toner images called chevron patch PV, on each of one edge portion, a central portion, and the other edge portion in the width direction of the intermediate transfer belt 8. The optical sensor units 136 includes a first optical sensor 137 facing the one edge portion, a second optical sensor 138 facing the central portion, and a third optical sensor 139 facing the other edge portion. The first optical sensor 137 causes light emitted from a luminescent device to pass through a condensing lens, causes the light to reflect at the surface of the intermediate transfer belt 8, receives the reflected light by a light receiving device, and outputs voltage depending on the amount of the received light. If the toner image in the chevron patch PV formed on the one edge portion of the intermediate transfer belt 8 passes through immediately below the first optical sensor 137, the amount of the light received by the light receiving device in the first optical sensor 137 changes significantly. Due to this change, the main controlling part can detect each toner image in the chevron patch PV formed on the one edge portion in the width direction of the intermediate transfer belt 8. Similarly, the main controlling part can detect each toner image in the chevron patch PV formed on the central portion of the intermediate transfer belt 8 based on the output from the second optical sensor 138. Further, the main controlling part can detect each toner image in the chevron patch PV formed on the other edge portion of the intermediate transfer belt 8 based on the output from the third optical sensor 139. Then, the main controlling part can detect the amount of positional displacement of each toner image based on the detection timing. In this way, the first optical sensor, the second optical sensor, and the third optical sensor 139 respectively function as the positional displacement detecting device in combination with the main controlling part. Meanwhile, a LED or the like, which has amount of light sufficient for producing a reflected light required for detecting a toner image, is used as the luminescent device. A CCD or the like, in which a multitude of light receiving elements are arranged linearly, is used as the light receiving device.

Figure 5:
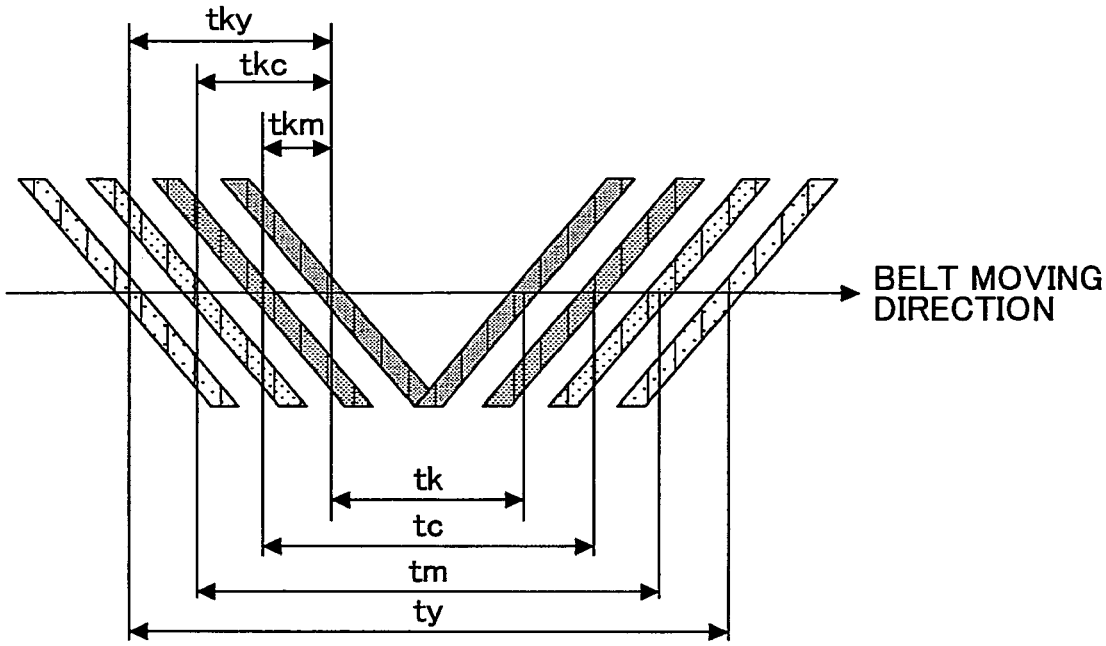
FIG. 5 is a magnified pattern diagram of a chevron patch formed on the intermediate transfer belt.

The main controlling part detects, for each toner image, the position in the main scanning direction, the position in the sub scanning direction (in the belt moving direction), the scaling factor error in the main scanning direction, and the skew to the main scanning direction, by detecting each toner image in the chevron patch PV. The term "main scanning direction" here represents a direction in which laser light moves on a surface of a photoreceptor with a reflection on a polygon mirror. As shown in FIG. 5, the chevron patch PV represents line patterns arranged at a predetermined pitch in the belt moving direction (in the sub scanning direction). Each of the line patterns corresponds to each of the color toner images for Y, C, M, and K inclined at about 45 degree angle to the main scanning direction. For the toner images for Y, C, and M in such chevron patch PV, the main controlling part reads out a difference between a detection time of each of the toner images for Y, C, and M on the one hand and that of the toner image for K on the other hand. In the FIG. 5, up-down direction in the plane of paper corresponds to the main scanning direction, starting from the left, the toner images for Y, C, M, and K are arranged, then the toner images for K, M, C, and Y, whose inclined angles are 90 degrees different from the toner images for Y, C, M, and K, follow. Based on the difference between actual measured values and theoretical values in the detection time difference tky, tkc, and tkm from K (a reference color), the main controlling part derives amount of positional displacement of each color toner image in the sub scanning direction, i.e. the amount of registration shift. Then, based on the amount of registration shift, the main controlling part corrects the time of initiation of optical writing to the photoreceptors or an inclination of the reflective mirror, and reduces the amount of registration shift in each color toner image. The main controlling part also derives an inclination (a skew) of each color toner image to the main scanning direction based on the difference between the amount of displacement in the sub scanning direction at the one edge portion of the intermediate transfer belt 8 and the amount at the other edge portion. Then, based on the result, the main controlling part executes the optical face tangle error correction of the reflective mirror and reduces the skew shift of each color toner image. As mentioned above, the writing position correcting process represents a process for reducing the registration shift or the skew shift by correcting the time of initiation of optical writing and the like based on the detection timing of each toner image in the chevron patch PV which serves as the color shift detecting image.

If the correction of the writing position of the latent image in relation to the photoreceptor is achieved by correcting the time of initiation of the optical writing, the correction is executed as follows. That is, in the configuration such as this printer which executes an optical scanning in the main scanning direction to each photoreceptor by deflecting four laser lights, each of which corresponds to each of the photoreceptors 1Y, 1C, 1M, and 1K by using a common single polygon mirror, the time of initiation of optical writing to each photoreceptor is corrected per unit time corresponding to the time required for writing a line (a scanning line). For example, if there is a registration shift beyond ½ dots between two photoreceptors, the time of initiation of optical writing to one of the two photoreceptors is shifted back and forth by the integral multiple of the time required for writing a line. More specifically, in the case of ¾ dots superimposition shift for example, the time of initiation of optical writing is shifted back and forth in relation to the previous timing by the time required for writing a line, while in the case of 7/4 dots superimposition shift for example, the time of initiation of optical writing is shifted back and forth in relation to the previous timing by twice the time required for writing a line. In this way, the amount of the superimposition shift in the sub scanning direction is reduced to below ½ dots. Thus, even just after the writing position correcting process is executed, there may be cases where each color dot can not be superimposed completely without shifts.

If the registration shift of each color dot is reduced by adjusting the inclination of the reflective mirror in the optical writing unit 7, just after the writing position correcting process is executed, each color dot can be superimposed almost without shifts.

Figure 6:
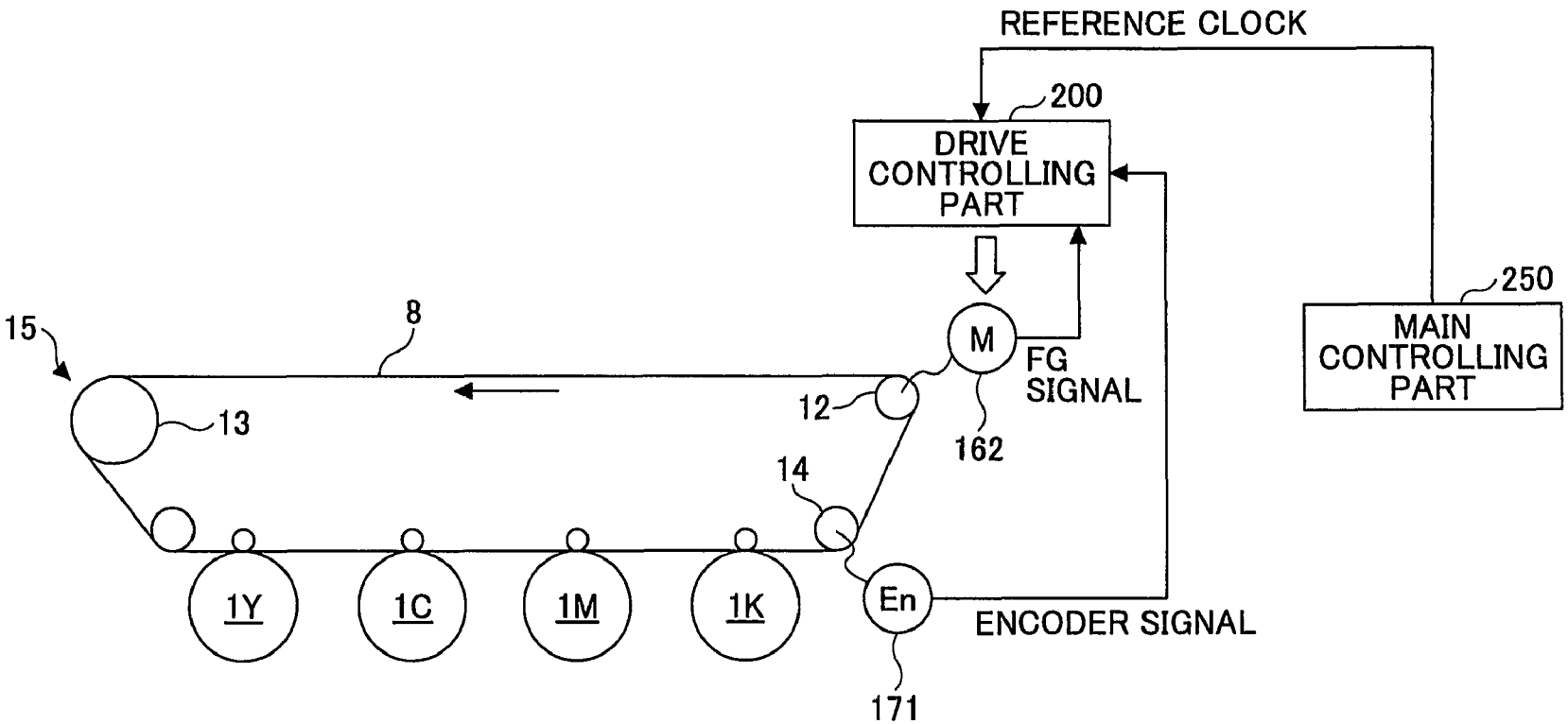
FIG. 6 is a schematic block diagram illustrating a drive controlling part and a main controlling part as well as various devices electrically connected thereto.

FIG. 6 is a schematic block diagram illustrating a drive controlling part 200 and a main controlling part 250 which serve as a drive controlling device as well as various devices electrically connected thereto. A linear speed of driven roller 14, which is one of tensioning members for tensioning the intermediate transfer belt 8 inside a loop of the belt and driven by the movement of the belt, is the same as the linear speed of the intermediate transfer belt 8. Thus, the angular speed and the angular displacement of the rotating driven roller 14 indirectly indicate the moving speed of the endless intermediate transfer belt 8. A roller encoder 171 composed of a rotary encoder is attached to the shaft member of the driven roller 14. This roller encoder 171 detects the angular speed and the angular displacement of the rotating driven roller 14, and outputs the result to the drive controlling part 200. Such a roller encoder 171 functions as a speed detecting device for detecting the moving speed of the intermediate transfer belt 8. The drive controlling part 200 can cognize the speed variance and the moving speed of the intermediate transfer belt 8 based on the output from the roller encoder 171.

Although this printer uses the roller encoder 171 for detecting the angular speed and the angular displacement of the driven roller 14 as the speed detecting device, this printer may use other device for detecting speed variance and speed by using other method. For example, this printer may use an optical sensor for detecting the speed variance and the speed of the belt based on the time interval between the detections of tick marks of a scale which is arranged on the intermediate transfer belt 8 and which is composed of a plurality of the tick marks arranged in a circumferential direction of the intermediate transfer belt 8 at a predetermined pitch. The printer may also use an optical image sensor which is employed in an input device of a personal computer such as an optical mouse as a device for detecting speed variance and speed of the surface of the belt.

The printer uses a roller whose surface is covered by a surface layer made of elastic material such as rubber as the driven roller 14 so that the driving roller 12 can exert a strong grip force on the intermediate transfer belt 8. If the driving roller 12 is eccentric, speed variance, which is characterized by a one-cycle sine curve per rotation of the driving roller 12, arises on the intermediate transfer belt 8. In the case where the diameter of the driving roller 12 has a margin of error, even if the printer rotates the driving roller 12 at the angular speed as planned, the printer can not bring the linear speed of the driving roller 12 or the speed of the intermediate transfer belt 8 to the target speed.

To that end, the drive controlling part 200 executes a PLL control for acceleration and deceleration control of the driving motor 162 which serves as a driving source of the driving roller 12 so that the drive controlling part 200 can adjust frequency of pulse signals output from the roller encoder 171 to a frequency of a reference clock. Due to this, the drive controlling part 200 stabilizes the speed of the intermediate transfer belt 8 at the target belt speed by rotating the driven roller 14, to which the roller encoder 171 is attached, at a constant angular speed. That is, the drive controlling part 200 executes the constant belt speed control for moving the intermediate transfer belt 8 at the target belt speed independently of the diameter and the eccentricity of the driving roller 12 by controlling the driving speed of the driving motor 162 based on the speed of the intermediate transfer belt 8. In such a configuration, the drive controlling part 200 can move the intermediate transfer belt 8 at the target belt speed independently of the diameter and the eccentricity of the driving roller 12 by executing the constant belt speed control based on the detection result of the speed of the intermediate transfer belt 8.

Next, the characteristic configuration of the printer is described.

To meet the requirements for high speed printing in these days, by using a printer testing machine with the above mentioned basic configuration, the inventors have carried out an experiment for further speeding up of the print speed. In the experiment, the testing machine caused significant streaky image turbulence when using a cardboard as a recording paper. The inventors found out that this streaky image turbulence is attributed to the impact when the cardboard enters into the secondary transfer nip. Specifically, when the cardboard enters into the secondary transfer nip, the moving speed of the intermediate transfer belt 8 instantaneously reduces significantly due to the rapid increase in load. Under the condition of the print speed higher than before, the reduction rate also becomes larger. Consequently, if the testing machine feedbacks the speed reduction to the drive control of the driving motor 162, the testing machine instantaneously increases the speed of the intermediate transfer belt 8 excessively. If the instantaneous speed reduction at the time of feeding the cardboard into the nip and the subsequent instantaneous speed increase occur in series, since each color toner image is not transferred properly at each color primary transfer nip, the testing machine caused the streaky image disturbance. This streaky image disturbance is far more outstanding than the color shift caused by the eccentricity of the driving roller 12. Therefore, countermeasures should be taken in priority to the color shift.

To that end, the main controlling part 250 of this printer switches the control method of the driving motor 162 from the constant belt speed control to the constant motor speed control as needed. This constant motor speed control is a method for controlling the driving motor 162 based on a FG signal output from a FG signal generator of the driving motor 162 so that the motor shaft of the driving motor 162 rotates at a constant rotational speed. As is well known, the FG signal generator, which serves as a rotational speed detecting device, is build into the driving motor 162, sends out a pulse signal each time the motor shaft of the driving motor 162 rotates by a predetermined rotational angle. By controlling the driving motor 162 to bring the frequency of the FG signal to a predetermined frequency, the main controlling part 250 can rotate the driving motor 162 at a predetermined rotational speed. Although the speed of the intermediate transfer belt 8 instantaneously reduces significantly when the cardboard enters into the nip, since the intermediate transfer belt 8 stretches and a small gap between gears narrows at the same time, the rotational speed of the driving motor 162 does not reduce that much. Consequently, in the constant motor speed control, since rapid decrease of the rotational speed of the motor is not detected when the cardboard enters into the nip, the main controlling part 250 keeps on rotating the driving motor 162 at the target rotational speed stably from the entrance of the cardboard into the nip till the ejection of the cardboard from the nip. Thus, the main controlling part 250 prevents the speed of the belt member from instantaneously increasing excessively just after the cardboard enters into the nip. In this way, although the main controlling part 250 does not eliminate color shift due to the eccentricity of the driving roller 12, the main controlling part 250 can reduce the streaky image disturbance by switching the drive control from the constant belt speed control to the constant motor speed control as needed.

The main controlling part 250 switches from the constant belt speed control to the constant motor speed control as follows. That ds, the main controlling part 250 determines whether there is a high possibility of causing a streaky image disturbance based on a command from a user. Specifically, this printer is provided with a thickness information obtaining device for obtaining thickness information of a recording paper fed into the secondary transfer nip. Such a thickness information obtaining device includes, for example, an operating device such as a touch panel which receives thickness information entered by the user. It may be a thickness detecting device for detecting thickness of a recording paper based on an amount of displacement of a carrying roller pair, which sandwiches and carries the recording paper, at the time of sandwiching. If the thickness of the recording paper is relatively thin, the speed variance of the belt member when the recording paper enters into the nip is not that much. In contrast, if the thickness of the recording paper is relatively thick, since the speed variance of the belt member when the recording paper enters into the nip becomes relatively significant, it is more likely to cause the streaky image disturbance. To that end, the main controlling part 250 outputs a signal for instructing the drive controlling part 200 to switch from the constant belt speed control to the constant motor speed control if the thickness information obtained by the thickness information obtaining device is beyond a predetermined thickness. In this way, the drive controlling part 200 drives the driving motor 162 under the constant motor speed control temporarily.

The printer is configured to choose one out of three modes: a low speed mode for prioritizing image quality, a normal mode, and a high speed mode for prioritizing print speed, as a print speed mode based on a command from a user. In this configuration, even if a cardboard is used, the speed variance of the belt member when the cardboard enters into the nip is not that much in the low speed mode or in the normal mode. Thus, even if the thickness information obtained by the thickness information obtaining device is beyond the predetermined thickness, the main controlling part 250 does not output a signal for instructing the drive controlling part 200 to switch from the constant belt speed control to the constant motor speed control in the low speed mode and the normal mode. In this way, the drive controlling part 200 drives the driving motor 162 under the constant belt speed control in this case.

The printer is also configured to choose either the above mentioned monochromatic mode or the above mentioned chromatic mode as a color mode based on a command from a user. In monochromatic mode, the constant belt speed control is not necessarily executed because color shift does not occur. Rather, the constant motor speed control is more beneficial because it can drive the belt stably even if there is a rapid change in load on the belt. On that end, in the monochromatic mode, the main controlling part 250 is configured to output a signal for instructing the drive controlling part 200 to switch the constant belt speed control to the constant motor speed control in the low speed mode and in the normal mode independently of the thickness of the recording paper.

In this way, the main controlling part 250 can reduce the development of the streaky image disturbance by switching the control method from the constant belt speed control to the constant motor speed control in the case where there is a high possibility that a significant speed variance of the belt is caused when the cardboard enters into the nip or in the monochromatic mode.

However, significant color shift may be caused when the main controlling part 250 switches the control method from the constant belt speed control to the constant motor speed control. This significant color shift is caused by the following reasons. That is, in the constant motor speed control, the main controlling part 250 rotates the driving motor 162 at a predetermined target rotational speed. If the diameter of the driving roller 12 is as planned, an average linear speed of the driving roller 12 at the time is almost the same as the target belt speed. However, the diameter inevitably has a margin of error due to the limitation of machining accuracy. In the driving roller 12 whose diameter has a slight margin of error, an average linear speed of a roller surface, when rotating the driving motor 162 at the predetermined target rotational speed, slightly deviates from the target belt speed. Due to this deviation, in the constant motor speed control, the main controlling part 250 moves the intermediate transfer belt 8 at an average speed different from that in the constant belt speed control. Although the main controlling part 250 executes the writing position correcting process under the condition of the constant belt speed control, the main controlling part 250 can reduce color shift by the execution only when the main controlling part 250 drives the driving motor 162 under the constant belt speed control. If the main controlling part 250 changes the average speed of the intermediate transfer belt 8 by switching from the constant belt speed control to the constant motor speed control, the main controlling part 250 causes significant color shift. This is because, once the main controlling part 250 changes the average speed, the main controlling part 250 also changes time required for moving the belt from an upstream primary transfer nip to a downstream primary transfer nip, and then it becomes unable to superimpose toner images at each primary transfer nip without causing positional displacement.

To that end, the main controlling part 250 is configured to execute a target motor speed correcting process for correcting the target rotational speed of the driving roller 12 in the constant motor speed control to a speed corresponding to the diameter of the driving roller 12 when it is powered up by a user for the first time (at the first-time operation). The main controlling part 250 is also configured to execute the target motor speed correcting process when the transfer unit 15 is replaced with new one because the diameter of the driving roller 12 changes due to the replacement.

Figure 7:
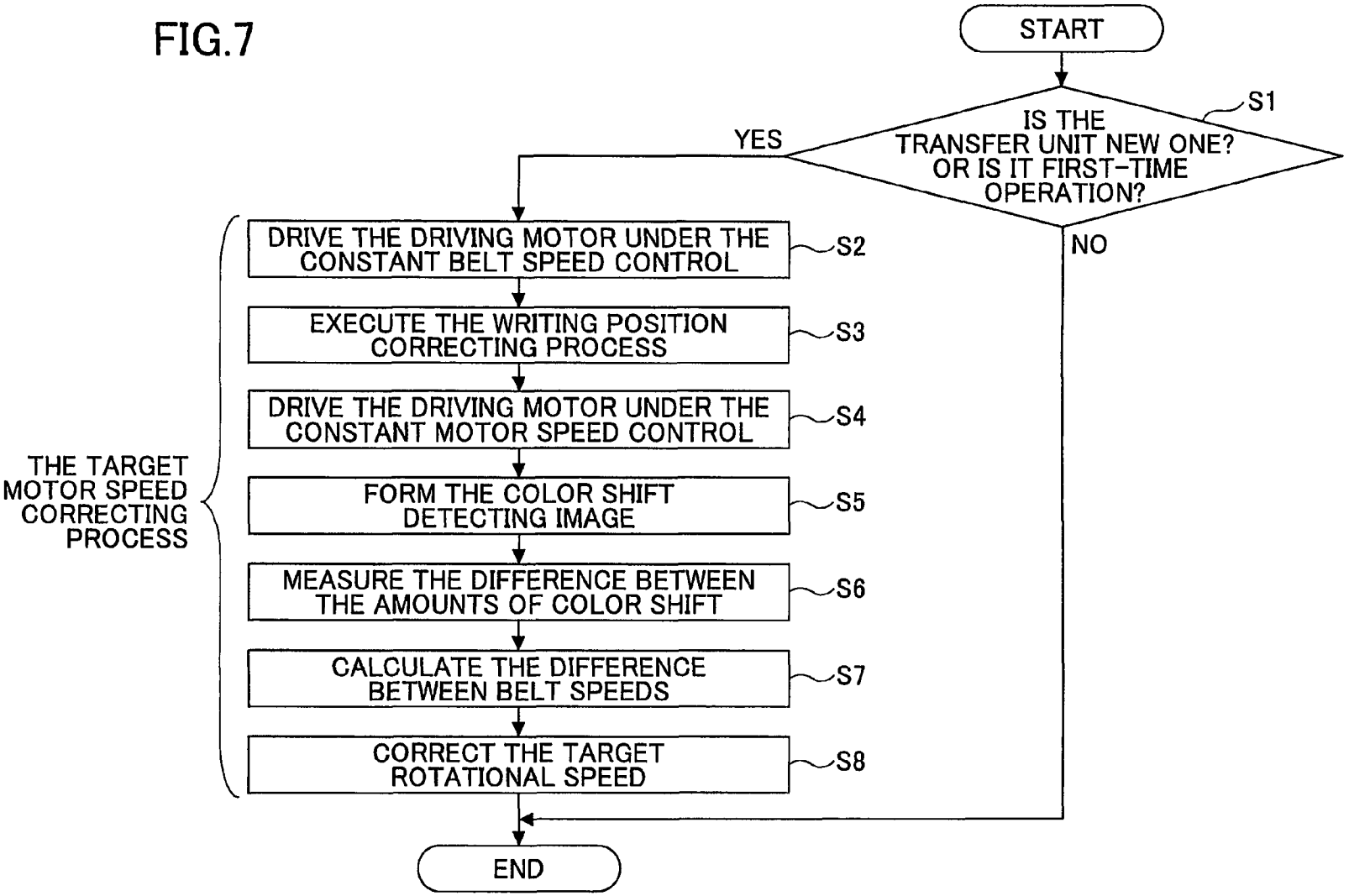
FIG. 7 is a flowchart illustrating a process flow of a target motor speed correcting process executed by the main controlling part.

FIG. 7 is a flowchart illustrating a process flow of the target motor speed correcting process.

The target motor speed correcting process is executed when the transfer unit 15 is replaced with new one or when an initial operation is carried out by a user (YES in Step 1) (Hereinafter "Step" is represented by "S"). Specifically, the target motor speed correcting process is executed, prior to a subsequent first print job, when the replacement of the transfer unit 15 is detected or when the initial operation is carried out.

Firstly, in the target motor speed correcting process, after starting the drive of the driving motor 16 under the constant belt speed control (S2), the main controlling part 250 executes the above mentioned writing position correcting process (S3). Thus, the main controlling part 250 reduces the amount of displacement of each color dot in the sub scanning direction under the condition that the driving motor 162 is driven by the constant belt speed control. Next, the main controlling part 250 switches the control method of the driving motor 162 from the constant belt speed control to the constant motor speed control (S4). Then, the amount of color shift increases due to change in the average speed of the intermediate transfer belt 8. Under such a condition, after forming an image for detecting color shift (S5), the main controlling part 250 measures the amount of color shift. Then, the main controlling part 250 derives the difference between the currently measured amount of color shift and the amount of color shift just after executing the writing position correcting process under the constant belt speed control (S6). Specifically, in the case where the main controlling part 250 corrects the writing position of each color electrostatic latent image by adjusting the inclination of the reflective mirror of the optical writing unit 7 in the writing position correcting process, as presented above, the main controlling part 250 can eliminate the positional displacement of each color dot almost completely. Thus, in this case, the above mentioned difference between the amounts of color shifts becomes equal to the value of the amount of color shift measured at S6. Meanwhile, in the case where the main controlling part 250 corrects the writing position of each color electrostatic latent image by adjusting the time of initiation of optical writing, as presented above, the main controlling part 250 may not eliminate the amount of the positional displacement of each color dot completely. Nevertheless, the main controlling part 250 reduces the amount of the positional displacement to at most less than ½. The main controlling part 250 calculates and stores the amount of the positional displacement of less than ½ which is caused after the correction of the time in the writing position correcting process. Then, the main controlling part 250 derives in S6 the difference between the calculated amount of the positional displacement and the amount of color shift in the image for detecting color shift formed in S5.

The main controlling part 250 forms an image, which is different from the image for detecting color shift in the writing position correcting process (the one shown in FIG. 5), as the image for detecting color shift in S5. Specifically, in this printer, the main controlling part 250 forms an image, which is composed of two colors (the Y toner image and the K toner image) out of four colors, as the image for detecting color shift formed in S5 (FIG. 7). The reason why the main controlling part 250 forms such an image for detecting color shift is as follows. That is, the difference between the amount of color, shift just after executing the writing position correcting process under the constant belt speed control and the amount of color shift detected under the constant motor speed control represents the difference between the linear speed of the belt in the constant belt speed control and that in the constant motor speed control. In this regard, even if the difference between linear speeds of the belt is identical, the difference between the amounts of color shift differs from color to color. Specifically, in the case of the Y toner image for example, it is transferred onto the intermediate transfer belt 8 at the primary transfer nip for Y, and passes through the primary transfer nip for C and the primary transfer nip for M sequentially before it moves to the primary transfer nip for K at the most downstream. In contrast, in the case of the C toner image, it is transferred onto the intermediate transfer belt 8 at the primary transfer nip for C, and passes through only the primary transfer nip for M before it moves to the primary transfer nip for K at the most downstream. Moreover, in the case of the M toner image, it is transferred onto the intermediate transfer belt 8 at the primary transfer nip for M, and moves to the primary transfer nip for K at the most downstream without passing through any other primary transfer nip. Since the distance between each primary transfer nip is identical, the time required for the Y toner image to proceed into the primary transfer nip for K after being transferred onto the intermediate transfer belt 8 is three times as much as that of the M toner image. Thus, the amount of positional displacement of the Y toner image in relation to the K toner image due to change in the average speed of the intermediate transfer belt 8 is also three times as much as that of the M toner image. Consequently, the main controlling part 250 detects the amount of change in the average speed of the intermediate transfer belt 8 at between Y and K three times more sensitive than at between M and K. To that end, in this printer, the main controlling part 250 is configured to form an image for detecting color shift composed of two colors (the Y toner image and the K toner image) in S5 (FIG. 7) in order to detect the amount of color shift between Y and K which enables the main controlling part 250 to detect the amount of change in the average speed of the intermediate transfer belt 8 most sensitively.

The main controlling part 250 calculates, between two colors Y and K, the difference between the amount of color shift just after executing the writing position correcting process under the constant belt speed control and the amount of color shift when subsequently switching the control method from the constant belt speed control to the constant motor speed control. Then the main controlling part 250 calculates the difference between the belt speeds based on the difference between the amounts of color shift. This calculation is achieved by multiplying the difference between the amounts of color shift by a predetermined coefficient. Then, the main controlling part 250 corrects the target rotational speed of the driving motor 162 (the target frequency of the FG signal) used in the constant motor speed control. Thus, in the case where the main controlling part 250 executes the constant motor speed control in the subsequent print job, since the main controlling part 250 can drive the intermediate transfer belt 8 at the same average speed as in the constant belt speed control, the main controlling part 250 can reduce the development of the streaky image disturbance.

Figure 8:
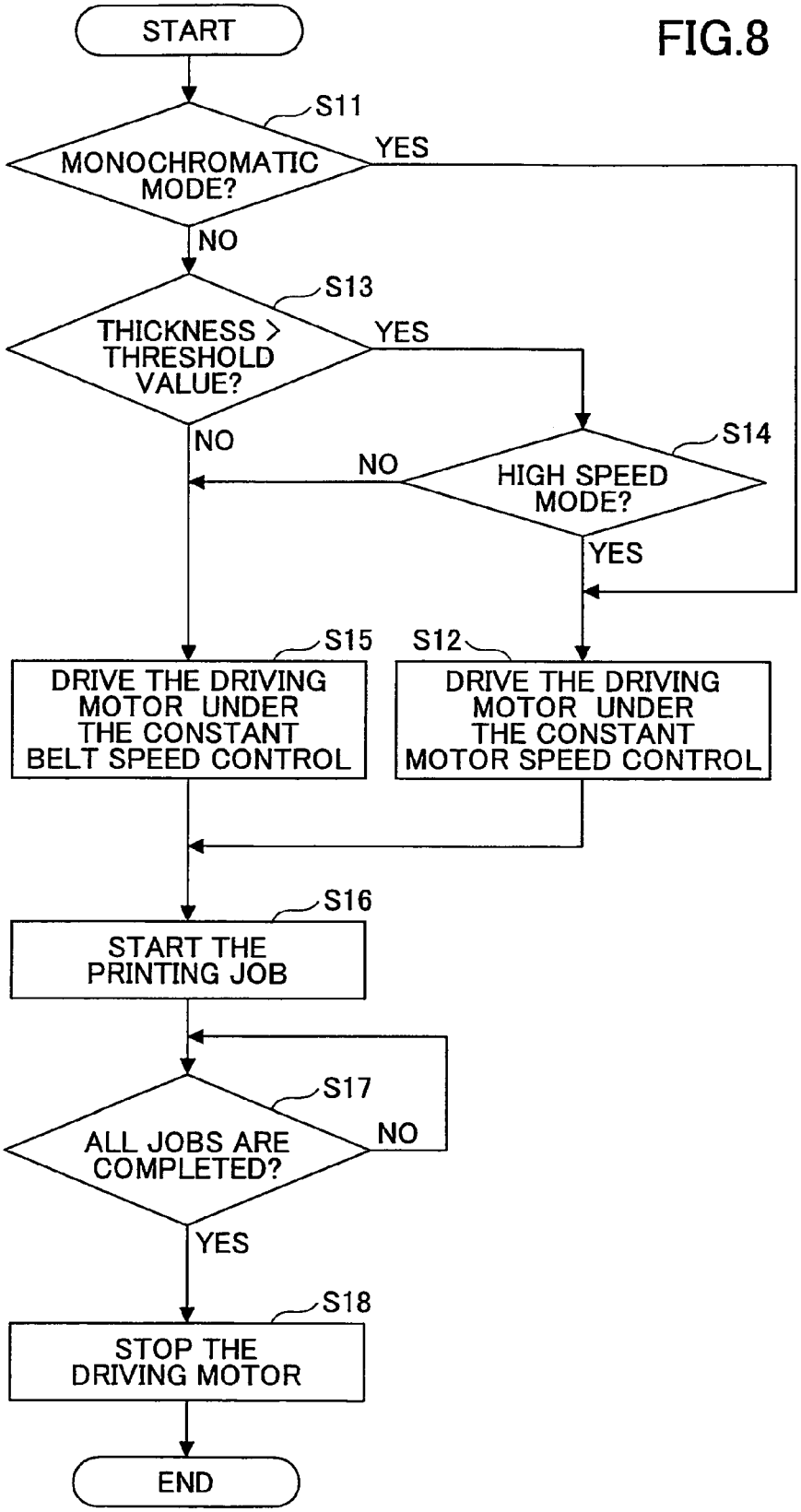
FIG. 8 is a flowchart illustrating a process flow of a print job.

FIG. 8 is a flowchart illustrating a process flow of a print job. Firstly, on receiving a print command from a user, the main controlling part 250 determines if it is in the monochromatic mode. If it is in the monochromatic mode (YES in S11), the main controlling part 250 drives the driving motor 162 under the constant motor speed control, and executes a print job as in S16-S18. On the contrary, if it is not in the monochromatic mode (NO in S11), in the case where there is a high possibility of increasing the speed variance of the belt when the cardboard enters into the nip such as the case where the thickness of the cardboard is beyond a threshold (YES in S13) and the print speed mode is the high speed mode (YES in S14), the main controlling part 250 executes a print job by switching the control method from the constant belt speed control to the constant motor speed control.

So far, the printer configured to execute the writing position correcting process under the condition of the constant belt speed control has been described. However, the printer may execute the writing position correcting process under the condition of the constant motor speed control. In this case, if the main controlling part 250 detects the replacement of the transfer unit, the main controlling part 250 executes the following process. That is, after executing the writing position correcting process under the condition of the constant motor speed control, the main controlling part 250 forms an image for detecting positional displacement under the condition of the constant belt speed control, and derives a difference between the amount of positional displacement in the constant belt speed control and the amount of positional displacement in the constant motor speed control. Then, the main controlling part 250 corrects, based on the derivation result, the target belt speed in the constant belt speed control to drive the belt at the same average speed as the one in the constant belt speed control.

As presented above, the printer in accordance with the embodiment is provided with a replacement detecting device for detecting the replacement of the transfer unit 15 or the belt unit based on the detection result of the optical sensor which optically detects the existence of the intermediate transfer belt 8 or the like. The main controlling part 250 is configured to execute the target motor speed correcting process prior to executing the first-time print job after the main controlling part 250 detects the replacement of the transfer unit 15 by the replacement detecting device, as well as executing the target motor speed correcting process prior to executing the first-time print job after the factory shipment. In such a configuration, the main controlling part 250 can rotate the driving motor 162 under the constant motor speed control at the target rotational speed corresponding to a diameter of the driving roller 12 even after the diameter of the driving roller 12 is changed due to the replacement of the transfer unit 15.

The main controlling part 250 is also configured to form an image, which includes the Y toner image by the Y photoreceptor and K toner image by the K photoreceptor which are arranged furthest away from each other among each color photoreceptor, as an image for detecting color shift in the target motor speed correcting process.

In such a configuration, the main controlling part 250 can detect change in speed most sensitively by forming the toner image with two colors (Y and K) which allows the main controlling part 250 to detect change in the average speed of the intermediate transfer belt 8 most sensitively, and can avoid unnecessary toner consumption due to the formation of a toner image with unnecessary colors.

The main controlling part 250 is also configured to choose either the constant belt speed control or the constant motor speed control depending on the thickness of a recording paper to which a print command from a user for forming an image is directed, i.e. depending on the thickness information of the recording paper. In such a configuration, the main controlling part 250 can switch the control method from the constant belt speed control to the constant motor speed control in the case where there is a high possibility that a relatively large speed variance of the belt occurs when the recording paper enters into a nip such as the case where a relatively thick recording paper is used.

The main controlling part 250 is also configured to choose either the constant belt speed control or the constant motor speed control depending on whether a print command from a user is for forming a chromatic image or for forming a monochromatic image, i.e. whether it is in the monochromatic mode or not. In such a configuration, the main controlling part 250 can reduce image degradation due to load change effectively by executing the constant motor speed control insusceptible to a rapid change in load on the belt in the monochromatic mode where color shift does not occur.

The main controlling part 250 is also configured to choose either the constant belt speed control or the constant motor speed control depending on an image forming speed to which a print command from a user for forming an image is directed, i.e. depending on the speed mode. In such a configuration, the main controlling part 250 can switch the control method from constant belt speed control to the constant motor speed control in the case where there is a high possibility that a relatively large speed variance of the belt occurs when the recording paper enters into the nip such as the case of the high speed mode.

The present invention is not limited to the specifically disclosed embodiments, and variations and modifications may be made without departing from the scope of the present invention.

The present application is based on Japanese priority application No. 2009-205521 filed on Sep. 7, 2009, the entire contents of which are hereby incorporated herein by reference.

What is claimed is:

1. An image forming device comprising:

an imaging part configured to form toner images having colors different from each other on a plurality of latent image carriers;

a belt unit having an endless belt member and a rotating body configured to move the belt member along with its rotation;

a transferring part configured to superimpose and transfer the toner images formed on the plurality of the latent image carriers onto a surface of the belt member or onto a recording member retained on the surface;

a driving motor serving as a drive source of the rotating body; and a controlling part configured to control the imaging part, the transferring part, and the driving motor;

wherein the controlling part executes:

a writing position correcting process configured to reduce a positional displacement of each color toner image by individually correcting each latent image writing position of the plurality of latent image carrier based on the amount of positional displacement of each color toner image in a color shift detecting image composed of at least two color toner images formed by the imaging part and the transferring part under the control of one of a constant motor speed control configured to drive the driving motor at a predetermined target rotational speed and a constant belt speed control configured to move the belt member at a predetermined target belt speed, and a speed correcting process configured to correct either the target rotational speed of the driving motor in the constant motor speed control or the target belt speed in the constant belt speed control based on an amount of positional displacement of each color toner image in a color shift detecting image formed under the control of the other of the constant motor speed control and the constant belt speed control.

2. The image forming device according to claim 1, comprising a replacement detecting part configured to detect replacement of the belt unit, wherein the controlling part is configured to execute the speed correcting process if replacement of the belt unit is detected by the replacement detecting part.

3. The image forming device according to claim 1, wherein, in the speed correcting process, the controlling part is configured to form the color shift detecting image by two color toner images on two latent image carriers arranged furthest away from each other.

4. The image forming device according to claim 1, wherein the controlling part is configured to choose either the constant belt speed control or the constant motor speed control depending on thickness of the recording member.

5. The image forming device according to claim 1, wherein the controlling part is configured to choose the constant motor speed control if an image to be formed is a monochromatic image.

6. The image forming device according to claim 1, wherein the controlling part is configured to choose either the constant belt speed control or the constant motor speed control depending on a image forming speed.

7. A control method of an image forming device, the image forming device comprising:

an imaging part configured to form toner images having colors different from each other on a plurality of latent image carriers;

a belt unit having an endless belt member and a rotating body configured to move the belt member along with its rotation;

a transferring part configured to superimpose and transfer the toner images formed on the plurality of the latent image carriers onto a surface of the belt member or onto a recording member retained on the surface;

a driving motor serving as a drive source of the rotating body; and a controlling part configured to control the imaging part, the transferring part, and the driving motor;

wherein the control method comprises the steps of:

reducing a positional displacement of each color toner image by individually correcting each latent image writing position of the plurality of latent image carrier based on the amount of positional displacement of each color toner image in a color shift detecting image composing of at least two color toner images formed by the imaging part and the transferring part under the control of one of a constant motor speed control configured to drive the driving motor at a predetermined target rotational speed and a constant belt speed control configured to move the belt member at a predetermined target belt speed, and correcting either the target rotational speed of the driving motor in the constant motor speed control or the target belt speed in the constant belt speed control based on an amount of positional displacement of each color toner image in a color shift detecting image formed under the control of the other of the constant motor speed control and the constant belt speed control.

* * * * *